United States Patent [19]

Lukehart

[11] Patent Number: 4,625,615

[45] Date of Patent: Dec. 2, 1986

[54] PICK FOR STRINGED INSTRUMENTS

[76] Inventor: Donald W. Lukehart, 8036 3rd St., Downey, Calif. 90241

[21] Appl. No.: 772,053

[22] Filed: Sep. 3, 1985

[51] Int. Cl.[4] ..... G10D 3/12

[52] U.S. Cl. ..... 84/322; D17/20

[58] Field of Search ..... 84/322; D17/20

[56] References Cited

U.S. PATENT DOCUMENTS

| | | | |
|---|---|---|---|
| 1,461,070 | 7/1923 | Rudesyle | 84/322 |
| 2,016,438 | 10/1935 | Kealoha | 84/322 |
| 3,735,663 | 5/1973 | Cowell | 84/322 |
| 4,347,773 | 9/1982 | Zook | 84/322 |

FOREIGN PATENT DOCUMENTS

| | | | |
|---|---|---|---|
| 2533344 | 4/1984 | France | 84/322 |

*Primary Examiner*—Lawrence R. Franklin

*Attorney, Agent, or Firm*—Kenneth T. Theodore

[57] ABSTRACT

The invention is an improvement in picks for stringed instruments which allows the user to firmly grip the pick for long periods of time without the customary fatigue associated with typical picks of today. Due to its unique construction, the improved pick is stronger and is securely storeable within the instrument's strings, thereby allowing longer usage of each pick. The pick is of the standard size and shape in use today except for the improvement thereon which is a singular raised portion on one surface and a complementary depression of the other surface. The user's forefinger lies within the depression and the thumb lies perpendicular across the raised portion for a firm, secure and comfortable grip.

4 Claims, 2 Drawing Figures

PICK FOR STRINGED INSTRUMENTS

BACKGROUND OF THE INVENTION

1. Field of the Invention

The invention lies within the field of musical instruments, specifically stringed musical instruments.

2. Description of the Prior Art

Picks used for stringed musical instruments are typically flat and tear-drop shaped and generally held by the user between his thumb and forefinger. To those knowledgeable in the arts, numerous improvements in picks are constantly being offered for use. Additionally, users themselves modify their picks to find a configuration and/or shape which is more suited to their style of play. Typically, the addition of tape and/or a non-slip substance to the pick's surface(s) or the addition of surface protrusions are known modifications to the pick. All such modifications above have one common purpose; that of making the pick less fatiguing to grip, expecially over long periods of play. With such a pick, the user's fingers would not tire as readily and the easy grip allows more playing with more comfort and hence more confidence over long periods of play.

All such modifications have failed to achieve their goals. Add on substances have not withstood the abuse it receives during long usage. Protrusions on the surface have not made the picks more comfortable because they have not conformed to the natural shape and position of the thumb and forefinger.

There is no known modification which permits a pick to be securely stored on the instrument with a minimum of effort and time.

SUMMARY & OBJECTS OF THE INVENTION

The improved pick is of the normal size and shape of a standard pick in use today, i.e., flat and of a tear-drop shape. The improvement consists of the addition of a shaped finger element on the pick's body with an elevated side for the user's thumb and a complimentary depressed side for said user's index finger. Said element originates from the central area of the pick and radiates outwardly therefrom. Said element increases in size as it radiates to the edge of the pick.

It is the primary object of the improved pick to provide a pick which is less fatiguing to use for long periods of time.

It is an additional object of the invention to provide a pick which is easily and securely stored within the instrument's strings and to overcome those objections of present picks enumerated above.

DESCRIPTION OF THE PREFERRED EMBODIMENT

While the preferred embodiment is illustrated and described below, it is to be understood that variations will be apparent to those skilled in the art without departing from the principles of the invention. Accordingly, the invention is not to be limited to the specific form described and illustrated but rather is to be limited only by a literal interpretation of the claims as appended herein.

Figure 1:
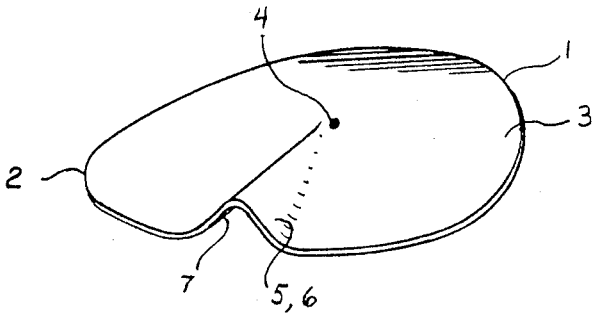
FIG. 1 is a perspective view of the invention.
Figure 2:
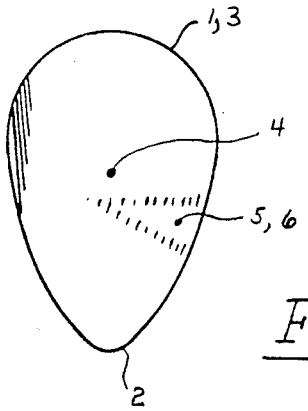
FIG. 2 is a plan view of the invention.

The improved pick 1, as illustrated in the perspective drawing of FIG. 1 and the plan view of FIG. 2, is of the standard size and shape generally used by those knowledgeable in the arts, i.e., tear-drop shaped with a somewhat pointed end 2. The pick 1 as illustrated is for a right handed user. The invention's description below applies to both a right handed and a left handed pick 1, the latter being a mirror image of the former. Said pick 1 has a planar body 3 except for the improvement as taught below.

Originating from the approximate central area 4 of said body 3, between said area 4 and end 2, a shaped finger element 5 progressively ascends from the surface of said body 3 radiating outwardly therefrom to the edge of said body 3. Said element 5 is triangular in cross sectional shape which increases in size as it radiates outwardly.

Said element 5 forms an elevated side 6 on the top of said body 3 and a complimentary depressed side 7 on the bottom of said body 3. The angle by which said element 5 radiates outwardly shall vary according to how a user holds a pick. The position illustrated in FIG. 2, whereby said element 5 is approximately perpendicular to said end 2, will accomodate the majority of users, as this is considered to be the correct position by teachers of the art. By this position the pick 1 is hold in the general area between the area 4 and end 2 using the user's thumb and the forward edge of the forefinger, near the fingernail. With the thumb approximately perpendicular to the forefinger, only a small portion of said end 2 protrudes from the fingers and in the proper attitude. Slight changes in the manufacturing process to vary the angle up to plus or minus 10 degrees will accomodate almost all users.

In use, the user's thumb lies on the elevated side 6 approximately perpendicular to said element 5. Additionally, the edge of the forefinger, at the approximate nail area, lies within said depressed side 7. Thus, said element 5 effectively provides a raised portion which is surrounded by the thumb and a trough like portion which surrounds the forefinger. Thereby the pick 1 is effectively locked to the user's fingers by utilization of the natural shape and position of the user's fingers. This permits the user to apply less force and reduced effort during play and thereby greatly reducing the fatigue normally experienced during extended play.

The element 5 also permits said pick 1 to be securely stored within the instruments strings. By sliding said pick 1 such that one string lies parallel to and within said depressed side 7, and the adjacent strings lie on each side of said elevated side 6, said pick 1 is thereby effectively locked to said strings.

Having fully described my invention, what I claim is:

1. A pick for a stringed musical instrument, said pick having a generally planar body consisting of a rigid, unitary material, being substantially tear-drop shaped having a top edge, two side edges, and a picking tip, the improvement comprising:

a single raised portion on one surface of said body and a complementary depression of the opposite surface, said raised portion and complementary depression originating from the approximate central area of said body and extending outwardly to one side edge of said body intermediate said picking tip and said top edge.

2. A pick as in claim 1 wherein said raised portion progressively ascends and widens from said approximate central area to said side edge, the cross-section thereof forming an apex and two sides of a triangle.

3. A pick as in claim 2 wherein the upper edge of said raised portion is approximately perpendicular to a plane bisecting the angle defined by said picking tip.

4. A pick as in claim 3 wherein the maximum width of said raised portion is substantially smaller than the length of said pick from said top edge to said picking tip.

* * * * *